United States Patent [19]

Poldervaart et al.

[11] Patent Number: 4,738,213

[45] Date of Patent: Apr. 19, 1988

[54] FLOATING DEVICE

[75] Inventors: Leendert Poldervaart; Willem C. De Boom, both of La Turbie, France

[73] Assignee: Single Buoy Moorings, Inc., Marly, Switzerland

[21] Appl. No.: 899,964

[22] Filed: Aug. 25, 1986

[30] Foreign Application Priority Data

Oct. 16, 1985 [NL] Netherlands ..... 8502829

[51] Int. Cl.[4] ..... B63B 39/02

[52] U.S. Cl. ..... 114/124

[58] Field of Search ..... 114/122, 123, 124, 126, 114/144 B, 145 R, 230, 293, 311; 441/22

[56] References Cited

U.S. PATENT DOCUMENTS

| | | | |
|---|---|---|---|
| 848,297 | 3/1907 | Englund | 114/145 R |
| 1,195,149 | 8/1916 | Ollard | 114/145 R |
| 3,407,766 | 10/1968 | Bergman et al. | 114/126 |
| 3,664,286 | 5/1972 | Chaney | 114/256 |

FOREIGN PATENT DOCUMENTS

| | | | |
|---|---|---|---|
| 740344 | 5/1969 | Belgium | 114/145 R |
| 1183742 | 7/1959 | France | 114/145 R |
| 114190 | 10/1978 | Japan | 441/22 |
| 57-134392 | 8/1982 | Japan | 114/122 |

OTHER PUBLICATIONS

"Auxiliary Braking Devices for Large Tankers", *The Motor Ship,* vol. 51, No. 599, Jun. 1970, pp. 157–158.

*Primary Examiner*—Joseph F. Peters, Jr.
*Assistant Examiner*—Jesûs D. Sotelo
*Attorney, Agent, or Firm*—Young & Thompson

[57] ABSTRACT

An elongated floating device connected via flexible means to the bottom of the water in such a manner that the floating device can undergo displacements through the action of wave forces while a structure is provided for redressing such displacements. At least one heavy plate extends in a vertical plane transversely to the length of the floating device, and is situated at a level below water level at least as low as the bottom of the floating device, and is suspended from the floating device so as to be freely pivotable about a horizontal axis which extends transversely to the length of the floating device. The plate has flat vertical opposite surfaces that are unconfined and are freely exposed in all horizontal directions to the ambient water.

8 Claims, 4 Drawing Sheets fig-3
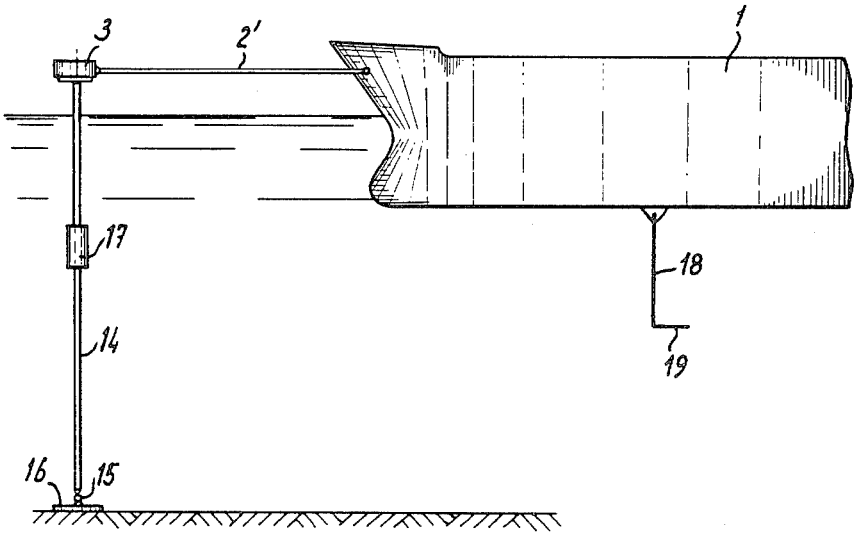
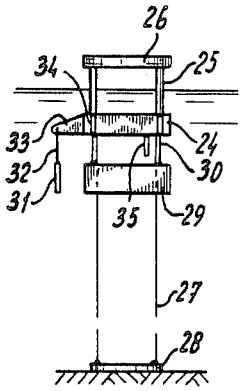
fig-4

FLOATING DEVICE

The invention relates to a floating device which is connected, either directly or indirectly via flexible means, to the bottom of the water in such a manner that the floating device can undergo displacements through the action of wave forces, while means are provided for redressing such displacements.

Numerous forms of construction of such floating devices are known. A floating island thus comes to mind, for example an island of the type which is partly submerged and intersects the surface of the water by its column-like parts, and which is coupled to the seabed by means of chains or by means of tension cables.

However, such a device may be a ship as well which is moored to a buoy or is moored to a floatable column pivotally connected to the seabed. It is also conceivable for the ship to be coupled by means of a rigid arm to the buoy or column or to a connection which is strong in tension and which is held under tensile stress by a buoyant body. In all these known devices means are provided for redressing the displacement of the floating device, in that as a consequence of the displacement a restoring component is produced which is brought about through the weight of the anchoring means or through the upwardly directed forces occurring therein and producing the restoring component when inclination occurs as the result of a displacement. This also occurs when the connection between the ship and the mooring device is in the form of an arm or system of arms, of which one end is coupled to a buoy, a column or a tower, and the end near the ship is coupled to the latter with the aid of flexible connection means which are loaded by a weight.

With all these devices the forces occurring may now give rise to displacements which may be of considerable size when weather conditions are bad. These displacements are the consequence not so much of the individual waves as of groups of waves, that is to say the successive individual waves show a pattern of large wave groups with a far longer period than that of the individual waves of each group. These displacements are called "surging".

Existing means for restoring the displaced device are frequently not able to suppress this surging completely.

The invention seeks to provide a simple solution to this problem.

This aim is achieved firstly in that said means are supplemented by additional means which consist of one or more plates disposed under the surface of the water and are fastened to the floating device, and which extend in a plane lying at a level below the influence of the waves and extend into the mass of water in such a manner and are so disposed transversely in relation to the direction of displacements that may occur that the floating device is so to speak held fast in said mass of water because the mass of water cannot flow around the plates without giving rise to extremely great resistance. In view of the fact that floating islands or big ships of great mass are concerned, large forces thus occur and this also means that the plates must be very strong and must be particularly securely fastened, and that the device itself must be able to take forces occurring via this fastening.

If the floating device consists of a ship, the plates may be situated on the sides of the hull, for example standing vertically at right angles to the longitudinal axis of the ship or standing vertically and forming an acute angle to the longitudinal axis of the ship with the apex of the angle directed oppositely to the direction of the waves. They may be swivellably mounted, so that they can be put out of action and will thus not hinder the ship during travel. The plate or plates may also be fastened to the bottom and thus extend downwards, optionally being retractable into a casing in the hull of the ship.

An extremely simple solution is obtained if the plate or plates is or are suspended to be freely swingably. In relation to the mass of the device which is to be held in position, such plates have large dimensions and therefore also a great weight. Their mass may optionally be increased, for example by using a plate of concrete or plates consisting of a flat box filled with concrete. The freely swingably suspension then has the consequence that on the displacement of the floating device the plate situated in the mass of water will lag behind the displacement of the floating device. The suspension means may consist of cables, chains or pivotally connected rods, and then come to form an angle to the vertical, thus supplying an additional restoring force through the weight of the lagging plate. A plate of this kind can be suspended on each side of the ship's hull, in which case the plate extends under the bottom of the ship; it can also be suspended on the connecting arm by which the ship is moored or may be provided at the mooring device itself.

In mooring devices care is always taken that the moored vessel can adjust itself with respect to current and wind, which accordingly means that it can swing around the mooring device.

In the case of a floating island, this is generally not the case. Once it has been secured, it retains its orientation even in the event of changes of direction of current and wind or of the direction of waves respectively.

According to the invention the plates can now be disposed in two directions at right angles to one another, for example parallel to the transverse and longitudinal directions of the island. These fastenings can then again be formed by fixed plates or by swingably suspended plates.

The invention will now be explained more fully with reference to the drawings.

FIG. 3 is a schematic side view of another embodiment of the invention.

FIG. 4 illustrates schematically in side view the application of the invention to a floating island.

Figure 1:
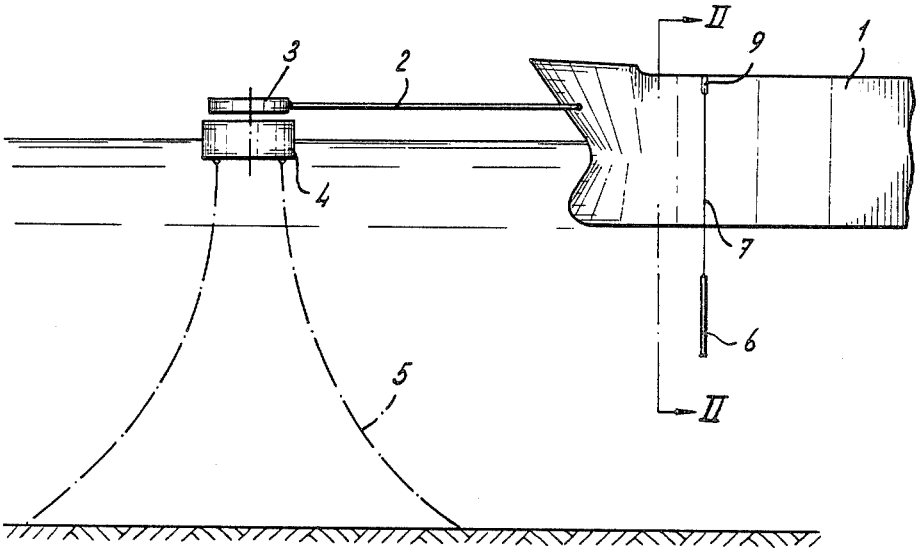
FIG. 1 is a side view of a first embodiment of the invention.
Figure 2:
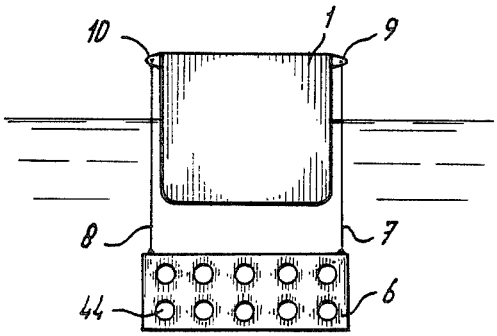
FIG. 2 is a corresponding front view on the line II—II in FIG. 1.

In the embodiment shown in FIGS. 1 and 2 the ship 1 is secured by means of a rigid arm 2 to the turn-table 3 of a buoy 4, which is connected to the seabed by means of anchor chains 5. In this embodiment the anchor chains supply the restoring force for the combination of the buoy and the ship 1.

According to the invention a heavy plate 6 is now suspended on the ship 1 by means of cables 7, 8, said plate being situated under the bottom of the ship. If "surging" occurs, the combination of ship and buoy will be displaced relative to the situation of the plate 6. The latter cannot immediately follow this displacement, so that the connecting means 7, 8 will assume an inclined position, with the consequence that a restoring force is produced at the fastening points of the connecting means 7, 8, these points being designated 9, 10.

FIG. 3 shows a ship 1 which is fastened by means of a cable 2' to the turntable 3 of a column 14 which at 15 is coupled by means of a universal joint with a bottom anchor 16 and is provided with a body 17 having buoyancy, which tries to keep the column 14 upright.

If the ship floats away from the mooring device 3, the column 14 will assume an inclined position and a restoring force will be produced which will bring the ship back. In view of the fact that this cannot suppress the so-called "surging", according to the invention a heavy plate 18 is pivotally suspended from the bottom of ship 1 and terminates downwardly in a rearwardly directed arm 19.

FIG. 4 shows a floating island provided with floats 24, columns 25, and a platform 26. This island is connected to the seabed anchor 28 by means of tension cables 27.

According to the invention plates 29 are now suspended on the longitudinal side with the aid of flexible suspensions means 30, while plates 31 are suspended on the transverse sides with the aid of flexible suspension means 32. In both cases they are suspended on jibs 33 and 34 respectively.

Fixed plates, such as those indicated for example at 35, are naturally also conceivable.

The same action is achieved with the suspended plates 19 and 21 in FIG. 3.

Figure 5:
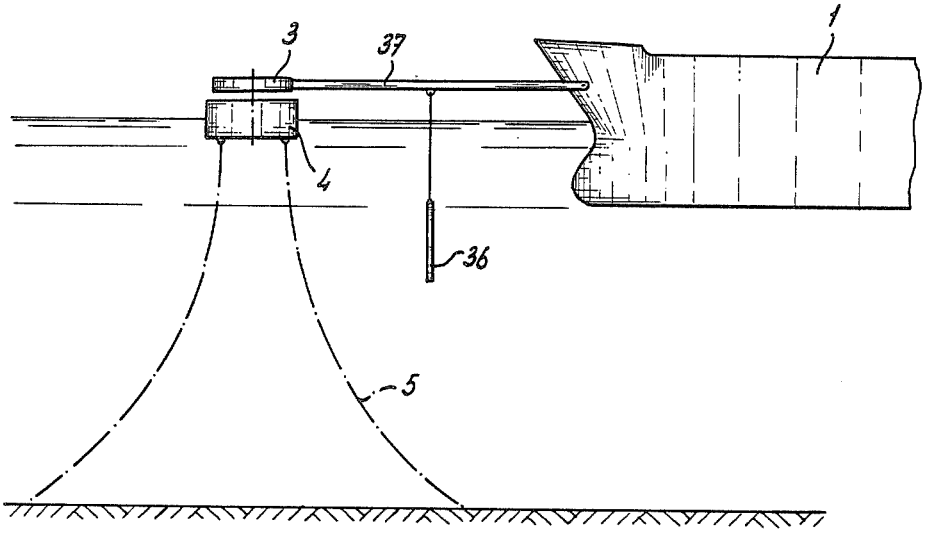
FIG. 5 shows a variant of the embodiment shown in FIG. 1.

FIG. 5 shows a variant of the embodiment shown in FIG. 1, the plate 36 being here suspended from the rigid arm 37.

Figure 6:
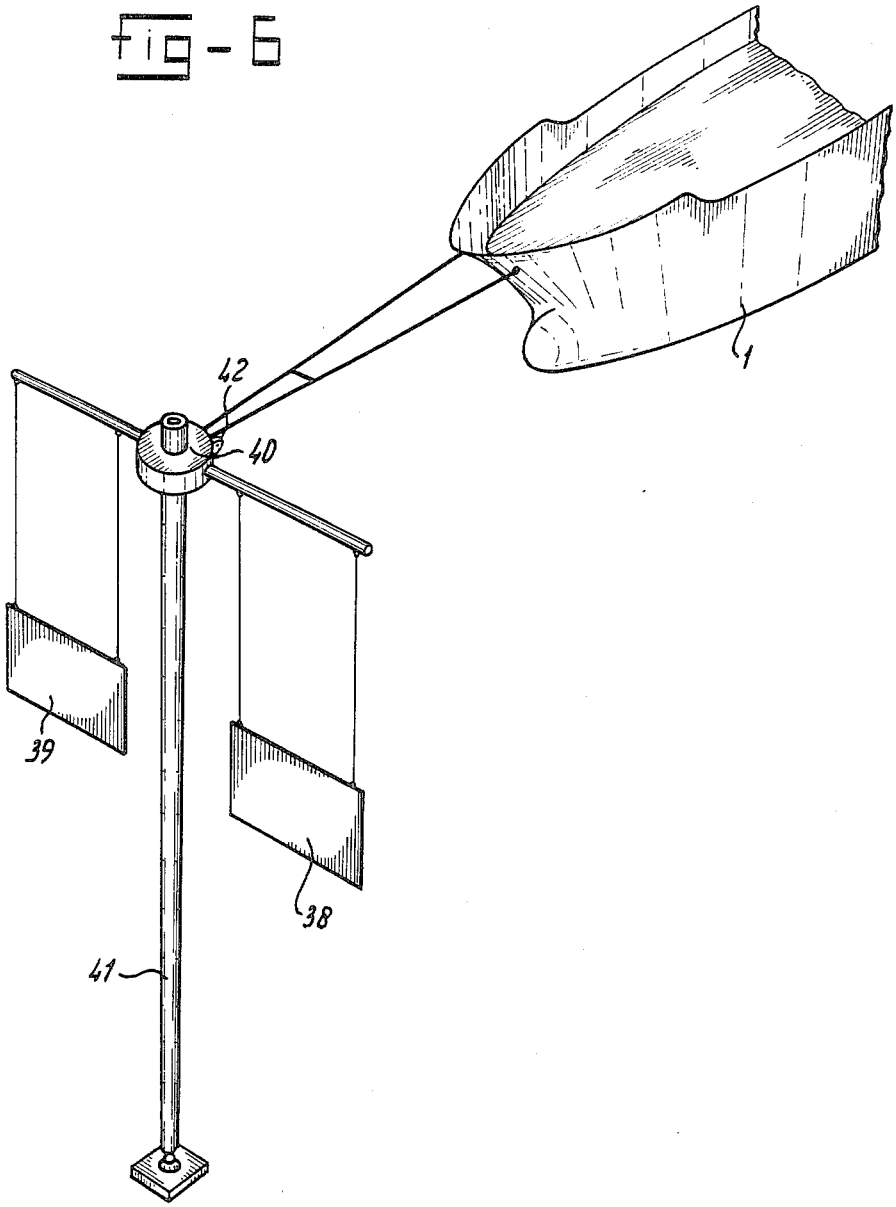
FIG. 6 shows in perspective another variant.

In the embodiment shown in FIG. 6, plates 38, 39 are suspended on the turntable 40 situated above the column 41, which is of similar construction to that shown in FIG. 3. If the ship 1 swings round, the turntable is turned by way of the horizontal pivot 42 extending transversely. The plates will then damp the turning movement and in the event of longitudinal displacements of the ship will supply a restoring force.

FIG. 2 shows that the plates may be provided with holes 44, preferably only in the upper part in case the L-shaped plate 43 is involved.

We claim:

1. In an elongated floating device comprising a mooring device and a ship moored thereto at a lateral distance from said mooring device, said mooring device being connected via flexible means to the bottom of the water in such a manner that the floating device can undergo displacements through the action of wave forces while means are provided for redressing such displacements; the improvement comprising at least one heavy plate in addition to said redressing means, which plate extends in a vertical plane transversely to the length of the floating device, is situated at a level below water level at least as low as the bottom of the floating device, is suspended from the floating device so as to be freely pivotable about a horizontal axis which extends transversely to the length of the floating device, and has flat vertical opposite surfaces that are unconfined and are freely exposed in all horizontal directions to the ambient water.

2. Floating device as claimed in claim 1, wherein the plate is pivotably connected to the bottom of the floating device.

3. Floating device as claimed in claim 1, wherein the plate is suspended from the floating device by means of tension-resistant connecting members which are pivotably connected to the plate and to the floating device.

4. Floating device as claimed in claim 3, wherein said tension-resistant members are cables.

5. Floating device as claimed in claim 3, wherein said tension-resistant members are connected to opposite sides of the floating device and the plate extends transversely under the bottom of the floating device.

6. Floating device as claimed in claim 1, wherein the ship is secured to the mooring device by means of a rigid arm, the plate being suspended from the arm.

7. Floating device as claimed in claim 1, the plate being suspended from the mooring device.

8. In a floating device in the form of a floating island connected via flexible means to the bottom of the water in such a manner that the floating island can undergo displacements through the action of wave forces while means are provided for redressing such displacements; the improvement comprising at least one pair of heavy plates which extend in vertical planes transverse to each other and are suspended from the floating device so as to be freely pivotable about horizontal axes parallel to the respective planes of the plates, the plates being situated at a level below water level at least as low as the bottom of the floating island.

* * * * *